US007751738B2

(12) United States Patent
Horiuchi et al.

(10) Patent No.: US 7,751,738 B2
(45) Date of Patent: Jul. 6, 2010

(54) IMAGE FORMING APPARATUS WITH CLEANING DEVICE FOR REMOVING REMAINING TONER FROM OUTER SURFACE OF THE INTERMEDIATE TRANSFER

(75) Inventors: Yoshinori Horiuchi, Osaka (JP); Mitsuhiro Hashimoto, Osaka (JP)

(73) Assignee: Kyocera Mita Corporation (JP)

( * ) Notice: Subject to any disclaimer, the term of this patent is extended or adjusted under 35 U.S.C. 154(b) by 139 days.

(21) Appl. No.: 11/657,901

(22) Filed: Jan. 25, 2007

(65) Prior Publication Data

US 2007/0172247 A1 Jul. 26, 2007

(30) Foreign Application Priority Data

Jan. 26, 2006 (JP) ..... 2006-017579

(51) Int. Cl.
*G03G 15/16* (2006.01)
*G03G 21/00* (2006.01)

(52) U.S. Cl. ..... 399/66; 399/349

(58) Field of Classification Search ..... 399/66, 399/71, 349, 101
See application file for complete search history.

(56) References Cited

U.S. PATENT DOCUMENTS 6,167,215 A * 12/2000 Miyashiro et al. ..... 399/66
7,215,920 B2 5/2007 Shida
2001/0048821 A1* 12/2001 Tomizawa et al. ..... 399/66
2005/0232668 A1* 10/2005 Shida ..... 399/354

FOREIGN PATENT DOCUMENTS

CN 1690883 5/2007
JP 2005-17424 1/2005

* cited by examiner

*Primary Examiner*—David M Gray
*Assistant Examiner*—Billy J Lactaoen
(74) *Attorney, Agent, or Firm*—Gerald E. Hespos; Michael J. Porco

(57) ABSTRACT

An image forming apparatus has an image former to form a toner image on an image bearer. A primary transferer transfers the toner image from the image bearer to the outer surface of an intermediate transferer as primary transfer by applying a primary transfer bias. A secondary transferer transfers the toner image from the outer surface of the intermediate transferer to a sheet as secondary transfer by applying a secondary transfer bias. A cleaner cleans the toner residual on the surface of the intermediate transferer after the secondary transfer by applying a cleaning bias having a polarity opposite to electric charges of the toner. A controller causes the intermediate transferer to rotate continuously and causes the primary transferer to apply the primary transfer bias until a toner image forming area on the outer surface of the intermediate transferer passes the primary transferer after the secondary transfer.

4 Claims, 6 Drawing Sheets

IMAGE FORMING APPARATUS WITH CLEANING DEVICE FOR REMOVING REMAINING TONER FROM OUTER SURFACE OF THE INTERMEDIATE TRANSFER

BACKGROUND OF THE INVENTION

1. Field of the Invention

The present invention relates to an electrophotographic image forming apparatus represented by a copier or a printer and particularly to an image forming apparatus for performing the primary transfer of a toner image formed using toners of a plurality of different colors from an image bearing member to the outer surface of an intermediate transfer member and the secondary transfer of the toner image from the outer surface of the intermediate transfer member to a sheet.

2. Description of the Related Art

A method for transferring a toner image by directly bringing a sheet into contact with a photoconductive drum or a method for performing the primary transfer of a toner image to an intermediate transfer member constructed by another drum or a belt and then the secondary transfer of the toner image transferred to the intermediate transfer member to a sheet are known as a method for transferring a toner image formed on the outer circumferential surface of a photoconductive drum as an image bearing member to a sheet in an electrophotographic image forming apparatus. Out of these methods, the latter method using the intermediate transfer member is widely used in the case of full-color printing using a plurality of different colors. In such a case, a superimposed toner image is formed on the outer surface of the intermediate transfer member by successively transferring toner images of a plurality of colors to the intermediate transfer member as the primary transfer and finally transferring the thus formed superimposed toner image to a sheet as the secondary transfer.

According to such a transfer method, a minute amount of toner remains on the outer surface of the intermediate transfer member without being transferred after the secondary transfer of the toner image to the sheet in some cases. Since the residual toner on the outer surface of the intermediate transfer member hinders a new image forming operation, the residual toner needs to be cleaned. A method for pressing a rotary member such as a roller or a rotary brush against the outer circumferential surface of the intermediate transfer member to transfer the residual toner to the rotary member for collection, a method for scraping the residual toner off by bringing a blade into contact with the outer surface of the intermediate transfer member and a cleaning method as a combination of the above two methods are widely known as cleaning methods used for such a purpose.

In the case of using a rotary member such as a roller or a rotary brush in the cleaning method for cleaning the residual toner on the outer surface of the intermediate transfer member, a cleaning bias having a polarity opposite to that of electric charges of the toner is normally applied to the rotary member during the cleaning. As a result, the residual toner on the outer surface of the intermediate transfer member can be transferred to the rotary member by an electrostatic force, whereby the residual toner can be easily cleaned and collected.

However, there are cases where the residual toner on the intermediate transfer member is charged to have an opposite polarity due to the injection of transfer charges upon the transfer of the toner image to the sheet through the application of a secondary transfer bias, separating discharge that occurs upon separating the sheet from the intermediate transfer member, and the like. If the residual toner on the intermediate transfer member is charged to have an opposite polarity, it has the same polarity as the cleaning bias applied to the rotary member such as a roller or a rotary bush at the time of cleaning the residual toner, making it difficult to clean and collect the residual toner. If the toner, which cannot be cleaned, remains on the outer surface of the intermediate transfer member, a next image forming process is adversely affected and there occurs an image error of attaching the toner to parts of the sheet that are supposed to be pure while without having no image.

In view of the above, a cleaning method has been proposed which has a good cleaning performance by devising a method for applying a cleaning bias to residual toner, which can be neither cleaned nor collected due to a polarity change as above, on the outer surface of the intermediate transfer member. One example of such a method is disclosed in Japanese Unexamined Patent Publication No. 2005-17424 (pages 4 to 5, FIG. 1).

According to a method for cleaning an intermediate transfer member of an image forming apparatus disclosed in this publication, a charging roller held in contact with the intermediate transfer member is provided without providing residual toner collecting means such as a cleaning device for the intermediate transfer member, and the toner residual on the outer surface of the intermediate transfer member is entirely charged at the same polarity opposite to a normal charged polarity, so that the residual toner can be collected by the cleaning device for an image bearing member provided in an image forming units. However, it is normally difficult to uniformly charge the entire toner residual on the outer surface of the intermediate transfer member as in this method and there is a high possibility that some of the toner cannot be charged to have the opposite polarity. Thus, the toner, which cannot be completely cleaned, remains on the outer surface of the intermediate transfer member, leading to a likelihood that a next image forming process is adversely affected and an image error occurs as described above.

SUMMARY OF THE INVENTION

An object of the present invention is to provide an image forming apparatus for performing printing by transferring a toner image formed using toners of a plurality of different colors from an image bearing member to an intermediate transfer member as primary transfer and then transferring the toner image from the intermediate transfer member to a sheet as secondary transfer, which apparatus can maintain a good cleaning performance by suppressing an occurrence of an error in cleaning the toner residual on the outer surface of the intermediate transfer member and can securely prevent an occurrence of an image error.

One aspect of the present invention is directed to an image forming apparatus, comprising an image forming unit including an image bearing member and adapted to form a toner image on the image bearing member using toners of a plurality of different colors; a rotatable intermediate transfer member; a primary transfer device for transferring the toner image from the image bearing member to the outer surface of the intermediate transfer member as primary transfer by applying a primary transfer bias; a secondary transfer device for transferring the toner image from the outer surface of the intermediate transfer member to a sheet as secondary transfer by applying a secondary transfer bias; a cleaning device for cleaning the toner residual on the outer surface of the intermediate transfer member after the secondary transfer by applying a cleaning bias having a polarity opposite to the charged polarity of the toner; and a controller for causing the intermediate transfer member to continuously rotate and causing the primary transfer device to apply the primary transfer bias from the start of the application of the primary transfer bias until a toner image forming area on the outer surface of the intermediate transfer member passes the primary transfer device after the secondary transfer.

These and other objects, features, aspects and advantages of the present invention will become more apparent upon a reading of the following detailed description and accompanying drawings.

DETAILED DESCRIPTION OF THE PREFERRED EMBODIMENTS

Hereinafter, embodiments of the present invention are described with reference to FIGS. 1 to 6.

Figure 1:
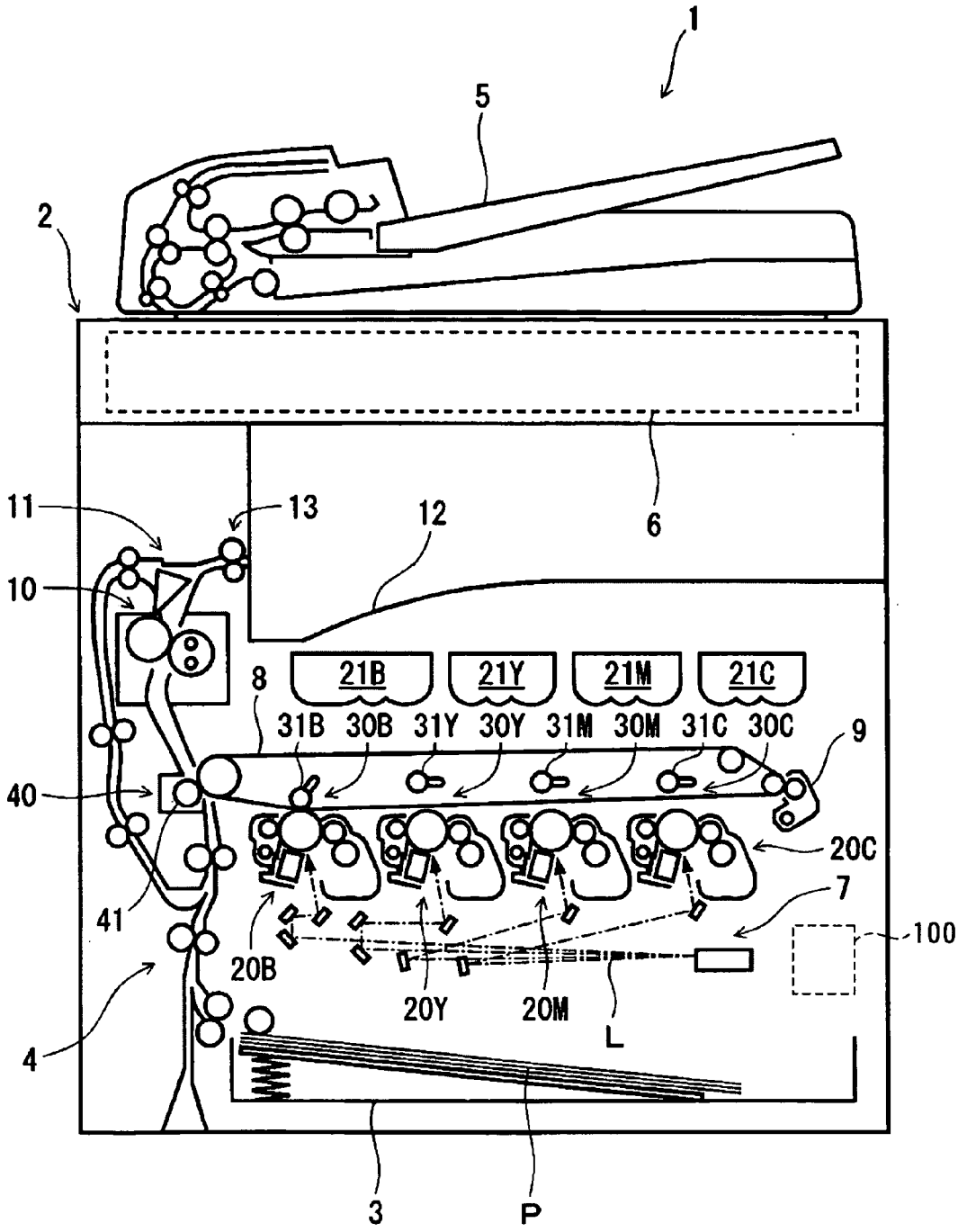
FIG. 1 is a schematic front view in vertical section of an image forming apparatus according to a first embodiment of the invention.
Figure 2:
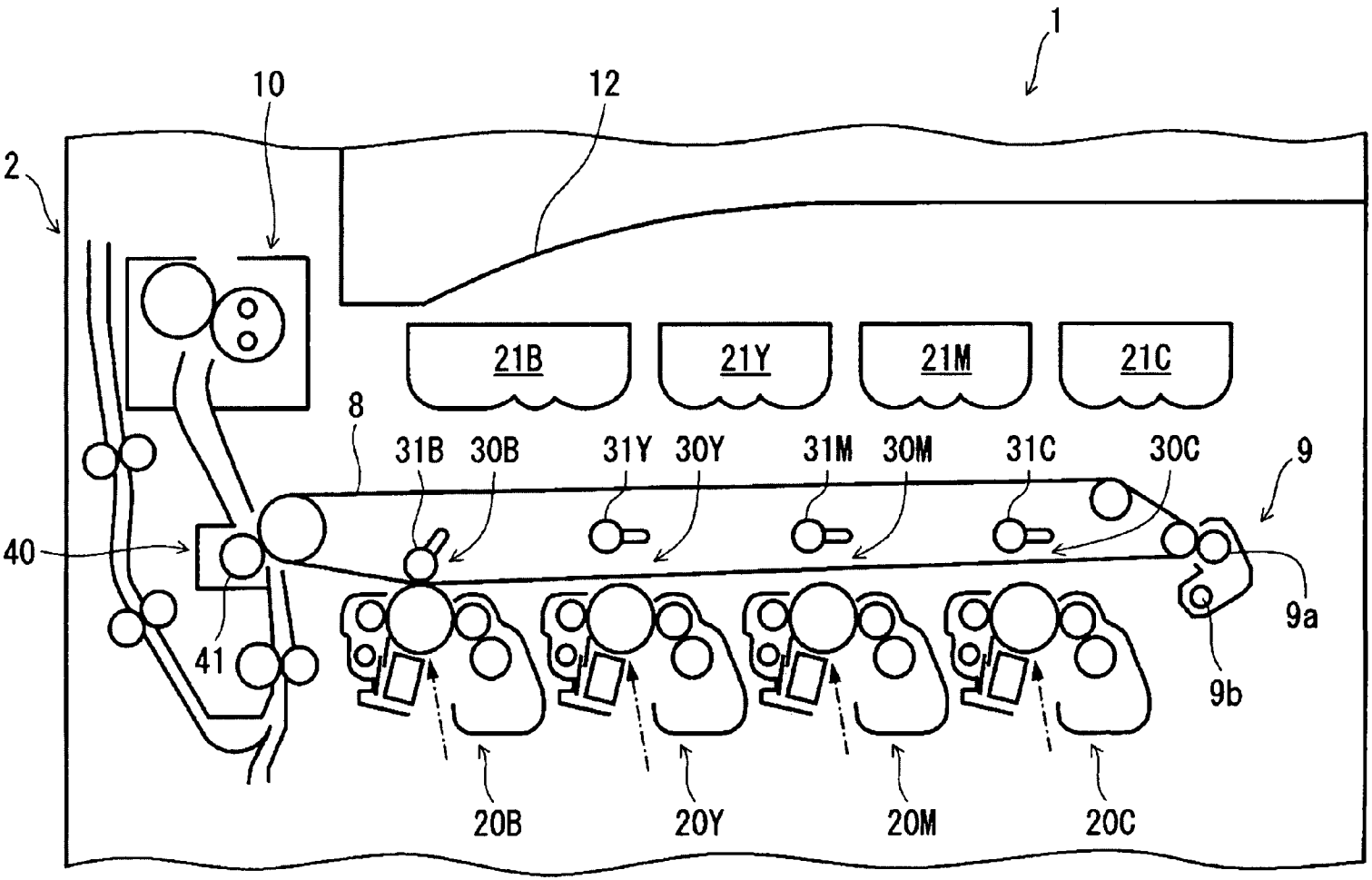
FIG. 2 is a partial enlarged vertical section showing the periphery of an intermediate transfer belt shown in FIG. 1.

First, the construction and operation of an image forming apparatus 1 according to a first embodiment of the present invention are outlined with reference to FIGS. 1 and 2. FIG. 1 is a schematic front view in vertical section of the image forming apparatus 1 and FIG. 2 is a partial enlarged vertical section showing the periphery of an intermediate transfer belt shown in FIG. 1. This image forming apparatus 1 is of the color printing type that transfers a color toner image to a sheet using the intermediate transfer belt.

As shown in FIG. 1, a sheet cassette 3 is arranged at the bottom of the interior of a main body 2 of the image forming apparatus 1. A stack of sheets P such as cut sheets of paper before printing are accommodated in the sheet cassette 3. The sheets P are separated and dispensed one by one toward an upper left side of the sheet cassette 3 in FIG. 1. The sheet cassette 3 is horizontally withdrawable, for example, from the front surface of the main body 2.

A sheet conveying assembly 4 is arranged to the left of the sheet cassette 3 inside the main body 2. The sheet P dispensed from the sheet cassette 3 is conveyed vertically upward along a side surface of the main body 2 to reach a secondary transfer device 40 by the sheet conveying assembly 4.

On the other hand, a document feeder 5 is arranged at an upper part of the image forming apparatus 1 and a document image reader 6 is arranged therebelow. In the case where a user copies a set of documents, he places the documents written with images such as characters, figures or patterns in the document feeder 5. The documents are separated and fed one by one in the document feeder 5, and image data thereof are read by the document image reader 6. The information of this image data is sent to a laser emitter 7 as exposing means disposed above the sheet cassette 3. A laser beam L controlled based on the image data is emitted toward image forming units 20 by the laser emitter 7.

A total of four image forming units 20 are arranged above the laser emitter 7, and an intermediate transfer belt 8 in the form of an endless belt capable of endless rotation is used as an intermediate transfer member above these image forming units 20. The intermediate transfer belt 8 is supported by being mounted on a plurality of rollers and turned in clockwise direction in FIG. 1 by an unillustrated driving device.

As shown in FIGS. 1 and 2, the four image forming units 20 are so-called tandem image forming units arranged in a row from an upstream side toward a downstream side along the turning direction of the intermediate transfer belt 8. These four image forming units 20 are a cyan image forming unit 20C, a magenta image forming unit 20M, a yellow image forming unit 20Y and a black image forming unit 20B in this order from the upstream side. In order to replenish these image forming units 20 with toners, toner supplying containers 21C, 21M, 21Y, 21B corresponding to the image forming units 20C, 20M, 20Y, 20B are arranged above the intermediate transfer belt 8, and toners are supplied to the respective image forming units 20 by unillustrated conveying means. In the following description, distinguishing symbols "C", "M", "Y" and "B" are omitted unless it is particularly necessary to specify them.

In each image forming unit 20, an electrostatic latent image of the document image is formed by the laser beam L emitted by the laser emitter 7 as exposing means, and is developed into a toner image. A primary transfer device 30 including a primary transfer roller 31 is disposed above each image forming unit 20 with the intermediate transfer belt 8 located therebetween. The primary transfer roller 31 is vertically movable in FIG. 1 and brought into contact with and away from the intermediate transfer belt 8 according to need. As the primary transfer roller 31 is brought into pressing contact with the intermediate transfer belt 8, the intermediate transfer belt 8 comes into pressing contact with the image forming unit 20 from above, thereby forming a primary transfer nip portion, and the toner image formed in the image forming unit 20 is transferred to the outer surface of the intermediate transfer belt 8. The toner images of the respective image forming units 20 are transferred to the intermediate transfer belt 8 at specified timings as the intermediate transfer belt 8 is turned, whereby four toner images of cyan, magenta, yellow and black are superimposed on the outer surface of the intermediate transfer belt 8 to form a color toner image.

The secondary transfer device 40 is arranged at a position in the main body 2 where the intermediate transfer belt 8 passes a sheet conveyance path (place where the intermediate transfer belt 8 and the sheet conveyance path of the sheet conveying assembly 4 are proximate to each other). The secondary transfer device 40 includes a second transfer roller 41. The color toner image on the outer surface of the intermediate transfer belt 8 is transferred to a sheet P synchronously conveyed by the sheet conveying assembly 4 in a secondary transfer nip portion formed upon bringing the secondary transfer roller 41 into pressing contact with the intermediate transfer belt 8.

After the secondary transfer, the toner residual on the outer surface of the intermediate transfer belt 8 is collected (cleaned) by a cleaning device 9 for the intermediate transfer belt 8 disposed upstream of the cyan image forming unit 20C with respect to the turning direction of the intermediate transfer belt 8.

A fixing device 10 is disposed above the secondary transfer device 40. The sheet P having the unfixed toner image transferred thereon in the secondary transfer device 40 is conveyed to the fixing device 10, where the toner image is fixed by being heated and pressurized by a heating roller and a pressure roller.

A junction portion 11 is provided above the fixing device 10. The sheet P discharged from the fixing device 10 is discharged from the junction portion 11 to a sheet discharging portion 12 provided in the image forming apparatus 1 if no duplex printing is performed.

A discharge opening through which the sheet P is discharged from the junction portion 11 to the sheet discharging portion 12 functions as a switchback portion 13. In the case of duplex printing, a direction of conveyance of the sheet P discharged from the fixing device 10 is switched in this switchback portion 13. Then, the sheet P is conveyed downward through the junction portion 11 and the sheet conveyance path to the left of the fixing device 10 and the secondary transfer device 40, and conveyed to the secondary transfer device 40 again via the sheet conveying assembly 4.

An overall controller 100 is provided at a specified position in the main body 2. The overall controller 100 includes a ROM (read-only memory) storing various control programs, a RAM (random access memory) for temporarily saving data, and a microcomputer for reading the above control programs and the like from the ROM and implementing them, and is for executing various controls in the respective parts of the apparatus (functional parts such as the sheet conveying assembly 4, the document feeder 5, the document image reader 6, the image forming units 20, the primary transfer device 30, the secondary transfer device 40, and the cleaning device 9) in accordance with specified instruction commands inputted by means of an operation panel (not shown) and the like arranged at the front side of the main body 2 and detection signals from sensors disposed at specified positions of the apparatus. Particularly in this embodiment, the overall controller 100 controls the turning movement of the intermediate transfer belt 8 and the application of a primary transfer bias by the primary transfer roller 31 as described later.

Figure 3:
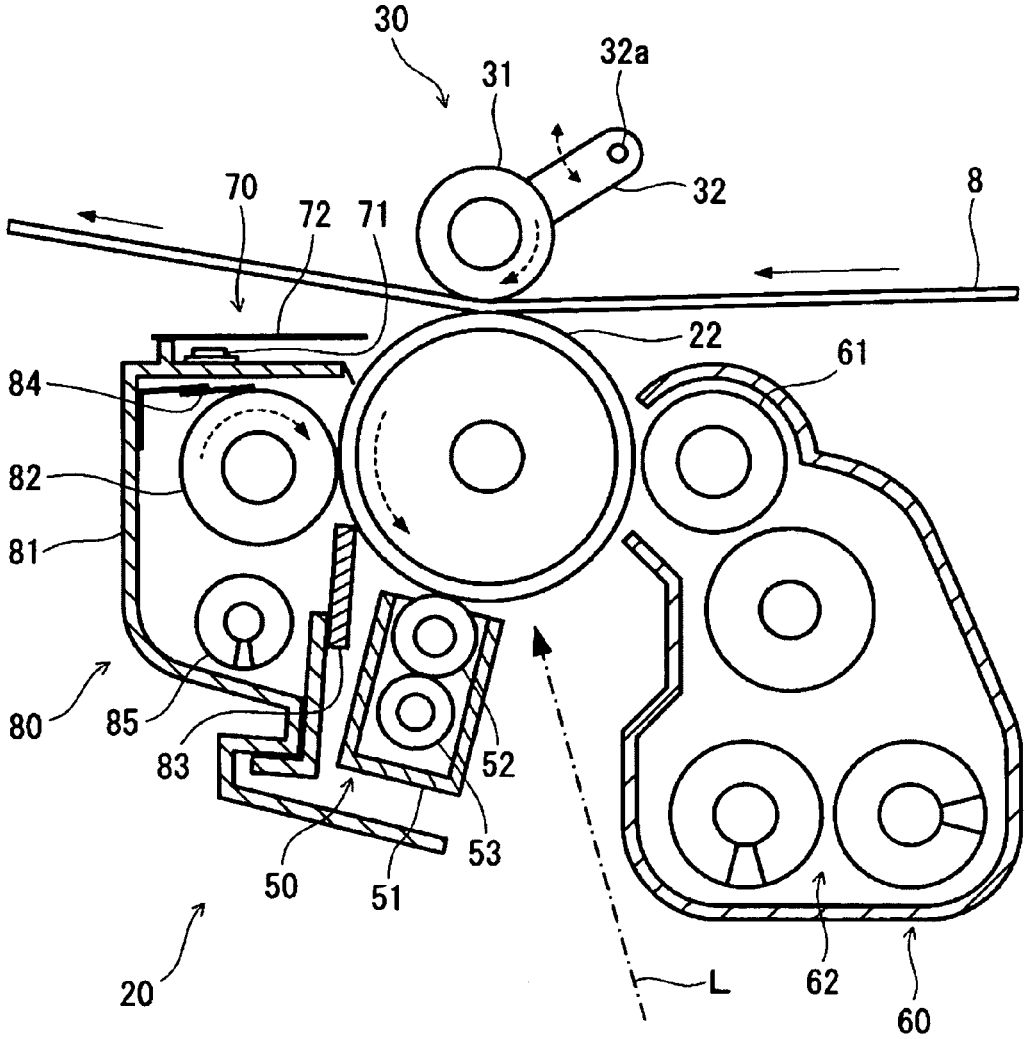
FIG. 3 is a partial enlarged vertical section showing the periphery of an image forming unit shown in FIG. 2.

Next, the detailed construction of the periphery of the image forming units 20 of the image forming apparatus 1 is described with reference to FIG. 3. FIG. 3 is a partial enlarged view in vertical section showing the periphery of the image forming unit 20. Since the image forming units 20 of the respective colors have a common construction, the distinguishing symbols "C", "M", "Y", and "B" are omitted as described above.

As shown in FIG. 3, the image forming unit 20 includes a photoconductive drum 22 as an image bearing member in the center thereof. A charging device 50, a developing device 60, a neutralizing device 70 and a drum cleaning device 80 are arranged around the photoconductive drum 22 in this order along a rotating direction of the photoconductive drum 22 (direction of arrow in FIG. 3). The primary transfer device 30 is arranged between the developing device 60 and the neutralizing device 70 along the rotating direction of the photoconductive drum 22.

The photoconductive drum 22 is an inorganic photoconductive drum formed by providing a layer of amorphous silicon, which is an inorganic photoconductive material, by vacuum deposition on the outer circumferential surface of a conductive roller base made of aluminum or the like, and has a diameter of 30 mm. The photoconductive drum 22 is rotated by an unillustrated driving device such that the circumferential speed thereof is substantially equal to a sheet conveying speed (e.g. 210 mm/sec.).

The charging device 50 has a charging roller 52 held in contact with the photoconductive drum 22 inside a housing 51. The charging roller 52 is comprised of a core, a conductive layer provided outside the core, and a resistive layer provided outside the conductive layer. The charging roller 52 is pressed in contact with the photoconductive drum 22 at a specified pressure and rotates with the rotation of the photoconductive drum 22. The outer circumferential surface of the photoconductive drum 22 is uniformly charged to have specified polarity and potential by this charging roller 52. It should be noted that a cleaning brush 53 is disposed at a position distanced from the photoconductive drum 22 with the charging roller 52 therebetween (via the charging roller 52) in the housing 51.

The developing device 60 includes a developing roller 61, which does not touch the photoconductive drum 22, in the vicinity of the photoconductive drum 22. A bias having the same polarity as the charged polarity of the photoconductive drum 22 is applied to the developing roller 61. The toner as developing agent is charged and is flown (rendered to fly) toward the electrostatic latent image on the outer circumferential surface of the photoconductive drum 22 by this developing roller 61, whereby the electrostatic latent image is developed. A nonmagnetic one-component toner is used as this toner, but two-component developing agent, which is mixture of magnetic carrier and nonmagnetic toner, may be used. The toner contained in the toner supplying container 21 (see FIG. 1) is conveyed to the position of the developing device 60 by the unillustrated conveying means and supplied by means of a feed screw 62. It should be noted that the developing roller may touch the photoconductive drum 22.

The primary transfer device 30 includes the primary transfer roller 31 held in contact with the photoconductive drum 22 via the intermediate transfer belt 8. The primary transfer roller 31 is comprised of a core and an electroconductive elastic layer provided outside the core. The electroconductive elastic layer is made, for example, of a polyurethane rubber having an electroconductive material such as carbon dispersed therein. The primary transfer roller 31 is supported on an unillustrated frame via an arm 32. The arm 32 is rotatable about a shaft portion 32*a* and the primary transfer roller 31 is vertically moved by this rotation. As the primary transfer roller 31 is moved downward at a specified timing to come into contact with the intermediate transfer belt 8, the intermediate transfer belt 8 is pushed down to touch the photoconductive drum 22, thereby forming the primary transfer nip portion. When the primary transfer roller 31 is moved upward, the intermediate transfer belt 8 moves away from the photoconductive drum 22. The primary transfer roller 31 has no driving device therefor and rotates with the turning movement of the intermediate transfer belt 8 by being held in contact with the intermediate transfer belt 8. Further, a primary transfer bias is applied to the primary transfer roller 31 according to needs.

The neutralizing device 70 is arranged further downstream of the primary transfer device 30 with respect to the rotating direction of the photoconductive drum 22, and includes a LED (light-emitting diode) 71 and a reflector 72. The LED 71 is mounted on the upper surface of a housing 81 of the cleaning device 80. Instead of the LED 71, an EL (electroluminescent) light source or a fluorescent lamp may be used. The reflector 72 is so disposed above the LED 71 as to cover the LED 71. The neutralizing device 70 removes electric charges on the outer circumferential surface of the photoconductive drum 22 by emitting a neutralizing beam of the LED 71 to the photoconductive drum 22.

The cleaning device 80 contains a cleaning roller 82 as a cleaning member, a cleaning blade 83, a scraper 84 and a discharge screw 85 in the housing 81 thereof. The cleaning roller 82 and the cleaning blade 83 has substantially the same length as the longitudinal length (drum width) of the photoconductive drum 22 and are so disposed as to touch the photoconductive drum 22. After the primary transfer of the toner image on the outer circumferential surface of the photoconductive drum 22 to the intermediate transfer belt 8, the cleaning roller 82 and the cleaning blade 83 clean the outer circumferential surface of the photoconductive drum 22 by removing the residual toner therefrom. The scraper 84 is disposed to touch the cleaning roller 82 from above in FIG. 2 and removes superfluous part of the toner attached to the outer circumferential surface of the cleaning roller 82 to even the toner layer. The toner removed from the outer circumferential surface of the photoconductive drum 22 is conveyed to the discharge screw 85 by the action of gravity and according to the rotation of the cleaning roller 82, and is further conveyed to the outside of the housing 81 by the discharge screw 85.

Figure 4:
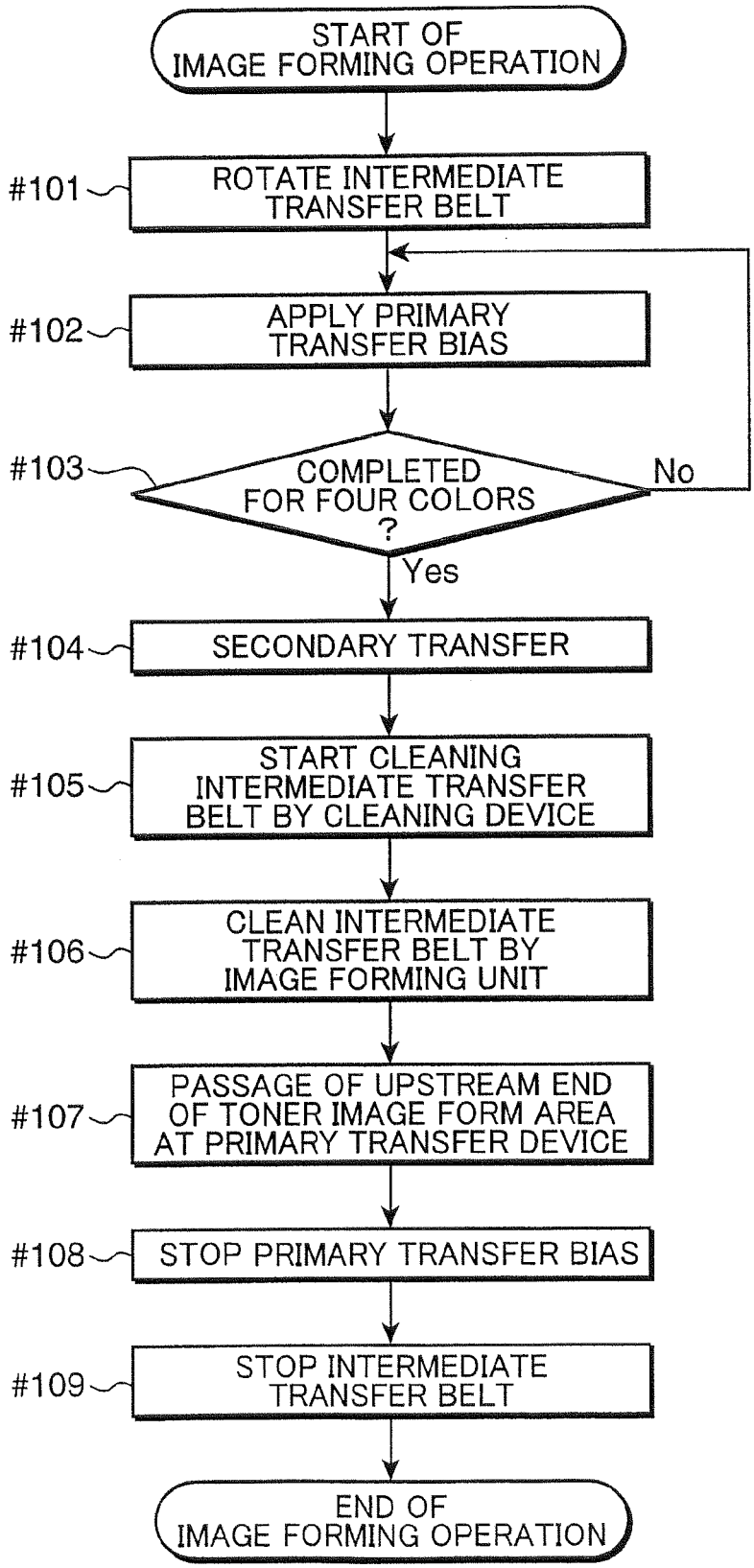
FIG. 4 is a flow chart showing an image forming operation by the intermediate transfer belt, the image forming units and their peripheral devices.

Next, a series of image formation related operations performed in the periphery of the intermediate transfer belt 8 and the image forming units 20 are described with reference to FIGS. 2, 3 and 4. FIG. 4 is a flow chart showing the image forming operation by the intermediate transfer belt 8, the image forming units 20 and their peripheral devices. It should be noted that, out of detailed steps of the image forming operation, those unnecessary to be particularly described are omitted in FIG. 4.

Upon starting the image forming operation, the intermediate transfer belt 8 is rotated in Step #101 shown in FIG. 4 in the periphery of the intermediate transfer belt 8 and the image forming units 20. The intermediate transfer belt 8 is turned in clockwise direction in FIG. 2 by the unillustrated driving device.

In the cyan image forming unit 20C located at a most upstream position out of the four image forming units 20, the outer circumferential surface of the photoconductive drum 22 is uniformly charged to have the specified polarity and potential by the charging roller 52 of the charging device 50 shown in FIG. 3. The charging potential at this time is normally about +200 to 1000 V. If a toner image to be formed is a black toner image (single-color printing), the charging operation is started in the black image forming unit 20B.

Subsequently, a laser beam L controlled by the laser emitter 7 (see FIG. 1) is emitted to the photoconductive drum 22 based on an image data read by the document image reader 6 (see FIG. 1), whereby the potential at illuminated parts is light-attenuated to form an electrostatic latent image of a document image on the photoconductive drum 22. Then, in the developing device 60, the electrostatic latent image is developed into a corresponding toner image on the outer circumferential surface of the photoconductive drum 22 by supplying the positively charged toner to the outer circumferential surface of the photoconductive drum 22 by means of the developing roller 61.

On the other hand, the intermediate transfer belt 8 is synchronized with the toner image formation on the outer circumferential surface of the photoconductive drum 22, and is pressed down by the primary transfer roller 31 to come into contact with the photoconductive drum 22. At this time, a negative primary transfer bias having a polarity opposite to the charged polarity of the photoconductive drum 22 and the toner is applied to the primary transfer roller 31 as shown in Step #102 of FIG. 4. Thus, the toner moves from the photoconductive drum 22 toward the primary transfer roller 31 (force trying to move the toner is created by this force), and the toner image is brought into contact with and transferred to the intermediate transfer belt 8.

The electric charges remaining on the outer circumferential surface of the photoconductive drum 22 after the primary transfer of the toner image to the intermediate transfer belt 8 are removed by the neutralizing device 70 to prepare for a charging step in the next image forming operation. After the electric charges are removed from the photoconductive drum 22, the toner residual on the outer circumferential surface of the photoconductive drum 22 are collected (cleaned) by the cleaning device 80.

Subsequently, in Step #103 shown in FIG. 4, it is judged whether or not the primary transfer has been completed for four colors. If the toner image to be formed is a black toner image, next Step follows since the primary transfer is not performed for the other three colors. If the toner image to be formed is a full-color toner image, the primary transfer (Step #102) of the toner image to the intermediate transfer belt 8 is repeated in the respective image forming units 20 with the turning movement of the intermediate transfer belt 8.

When the primary transfer by all the image forming units 20 is completed, the toner image reaches the secondary transfer device 40 by the turning movement of the intermediate transfer belt 8. Then, Step #104 follows, in which a negative secondary transfer bias having a polarity opposite to the charged polarity of the toner is applied to the secondary transfer roller 41 and the toner image on the outer surface of the intermediate transfer belt 8 is transferred to a sheet P synchronously conveyed by the sheet conveying assembly 4 in the secondary transfer nip portion.

Subsequently, Step #105 follows, in which the cleaning of the outer surface of the intermediate transfer belt 8 by the belt cleaning device 9 is started. At this time, a negative cleaning bias having a polarity opposite to the charged polarity of the toner is applied to the cleaning brush 9*a*. In this way, the residual toner on the outer surface of the intermediate transfer belt 8 moves from the intermediate transfer belt 8 toward the cleaning brush 9*a* and is collected (cleaned) by the discharge screw 9*b*.

The negatively charged toner (residual toner) to have a polarity opposite to the normal one in the image forming process remains on the outer surface of the intermediate transfer belt 8. Further, the unstably charged residual toner on the outer surface of the intermediate transfer belt 8 has a possibility of being negatively charged also by the cleaning brush 9*a* of the belt cleaning device 9.

If the intermediate transfer belt 8 continues to be turned, the toner image forming area on the outer surface thereof reaches the cyan image forming unit 20C. In the primary transfer device 30 opposed to the cyan image forming unit 20C, the primary transfer bias having a negative polarity continues to be applied to the primary transfer roller 31 after the primary transfer shown in Step #102. Then, Step #106 follows, in which the negatively charged residual toner on the outer surface of the intermediate transfer belt 8 repels against the primary transfer roller 31 having the negative primary transfer bias likewise applied thereto, thereby moving toward the positively charged photoconductive drum 22 to attach to the outer circumferential surface thereof. The residual toner having moved from the outer surface of the intermediate transfer belt 8 to the outer circumferential surface of the photoconductive drum 22 is cleaned and collected by the cleaning device 80 for the photoconductive drum 22.

Subsequently, when the toner image forming area on the outer surface of the intermediate transfer belt 8 passes the primary transfer device 30, specifically the upstream end (upstream end with respect to the turning direction of the intermediate transfer belt 8, i.e. an upstream end if the intermediate transfer belt 8 is turned from the upstream side toward the downstream side; may also be through as an end of a rear side (rear end) with respect to an advancing direction of the toner image forming area by this turning movement of the intermediate transfer belt 8) of the toner image forming area passes the primary transfer device 30 in Step #107, the application of the primary transfer bias to the primary transfer roller 31 is stopped in Step #108 and the turning of the intermediate transfer belt 8 is stopped in Step #109. In this way, a series of image formation related operations in the periphery of the intermediate transfer belt 8 and the image forming units 20 are completed.

It should be noted that, by the control of the overall controller 100, the intermediate transfer belt 8 continues to be turned and the primary transfer device 30 continues to apply the primary transfer bias after the start of the application of the primary transfer bias by the primary transfer device 30 (Step #102) until the toner image forming area on the outer surface of the intermediate transfer belt 8 passes the primary transfer device 30 after the secondary transfer by the secondary transfer device 40.

Further, the application of the primary transfer bias by the primary transfer device 30 may not be continued from the start thereof until the upstream end (rear end) of the toner image forming area passes the primary transfer device 30 after the secondary transfer. For example, the application of the primary transfer may be continued until the downstream end (leading end) of the toner image forming area passes the primary transfer device 30 next time by further turning the intermediate transfer belt 8 after the upstream end of the toner image forming area passes the primary transfer device 30 following the above secondary transfer. In short, it is sufficient to continue to apply the primary transfer bias at least until the toner image forming area (entire area) passes the primary transfer device 30 after the secondary transfer.

The negatively charged residual toner on the outer surface of the intermediate transfer belt 8 needs not always be collected (cleaned) in the cyan image forming unit 20C, and may be collected (cleaned) using any one of the other three image forming units 20 or a plurality of (part or all) of the four image forming units 20.

The process of cleaning the outer surface of the intermediate transfer belt 8 according to this embodiment described with reference to FIG. 4 (including not only the cleaning operation by the above cleaning device 80, but also a series of cleaning operations performed by continuously applying the primary transfer bias by means of the primary transfer device 30) can be performed between the image forming operations for successive sheets, i.e. during a period between the end of printing on a certain sheet and the start of printing on a next sheet in the process of continuously printing a plurality of sheets. In such a case, printing (printing operation) is continued for successive sheets without stopping the application of the primary transfer bias in Step #108 and stopping the intermediate transfer belt 8 in Step #109. However, this process of cleaning the outer surface of the intermediate transfer belt 8 is not limitedly performed between the image forming operations for successive sheets, and may be performed at any desired timing such as regular execution, for example, when the image forming apparatus 1 is turned on. It does not matter that the cleaning process never fails to be performed between the image forming operations for successive sheets.

As described above, in the image forming apparatus 1 in which the full color toner image is transferred from the intermediate transfer belt 8 to the sheet P as the secondary transfer after the toner images formed using the toners of a plurality of different colors are transferred as the primary transfer from the photoconductive drums 22 as the image bearing members to the intermediate transfer belt 8 as the intermediate transfer member, and the toner residual on the outer surface of the intermediate transfer belt 8 after the secondary transfer is cleaned by applying the cleaning bias having a polarity opposite to the charged polarity of the toner, the intermediate transfer belt 8 continues to be turned and the primary transfer bias continues to be applied until the toner image forming area of the outer surface of the intermediate transfer belt 8 passes the primary transfer device 30 after the secondary transfer of the toner image to the sheet P. Thus, out of the toner residual on the outer surface of the intermediate transfer belt 8, the toner charged to have the normal polarity can be collected by the cleaning device 9 for the intermediate transfer belt 8 and the toner charged to have the polarity opposite to the normal charged polarity can be collected by the cleaning devices 80 for the photoconductive drums 22 provided in the image forming units 20. Accordingly, the residual toner on the outer surface of the intermediate transfer belt 8 can be securely collected (cleaned) by the cleaning device for the intermediate transfer belt 8 or the cleaning devices for the photoconductive drums 22 regardless of whether the toner is charged positively or negatively in the image forming process. In this way, good cleaning performance can be maintained by suppressing an occurrence of a cleaning error, whereby the image forming apparatus 1 capable of securely preventing an occurrence of an image error can be provided.

The image forming apparatus 1 is of the tandem type in which the intermediate transfer member is the endless intermediate transfer belt 8 and a plurality of image forming units 20 including the photoconductive drums 22 and a plurality of primary transfer devices 30 are arranged in a row along the turning direction of the intermediate transfer belt 8, and the overall controller 100 causes any one of the plurality of primary transfer devices 30 to apply the primary transfer bias. Thus, the toner charged to have a plurality opposite to the normal charged polarity can be collected by the cleaning device 80 for the photoconductive drum 22 of any one of the image forming units 20 arranged along the intermediate transfer belt 8. Accordingly, good cleaning performance can be maintained and the tandem full-color image forming apparatus 1 can be provided which can more securely prevent an occurrence of an image error.

In the tandem image forming apparatus 1 having the above construction, the four image forming units 20 may be constructed such that primary transfer biases of plus and minus polarities or minus and plus polarities are alternately applied thereto from the most upstream one with respect to the turning direction of the intermediate transfer belt 8 after the secondary transfer of the toner image to the sheet P, i.e. primary transfer biases of different polarities are alternately applied to the toner image forming area on the intermediate transfer belt 8 as the intermediate transfer belt 8 is turned (the overall controller 100 controls the application of the respective primary transfer biases of the plurality of primary transfer devices 30 whose polarities are alternately arranged). In other words, a minus primary transfer bias is applied to the cyan image forming unit 20C, a plus primary transfer bias to the magenta image forming unit 20M, a minus primary transfer bias to the yellow image forming unit 20Y and a plus primary transfer bias to the black image forming unit 20B or vice versa.

In this way, the image forming units 20 of all the four colors arranged in a row along the turning direction of the intermediate transfer belt 8 can be utilized to collect the residual toner on the outer surface of the intermediate transfer belt 8 charged to have both positive and negative polarities. By alternately arranging the image forming units 20 to which a plus or minus primary transfer bias is applied, the residual toner having unstable charged polarity can be efficiently collected.

Accordingly, the cleaning performance can be further improved regardless of whether the residual toner on the outer surface of the intermediate transfer belt 8 is positively or negatively charged.

Figure 5:
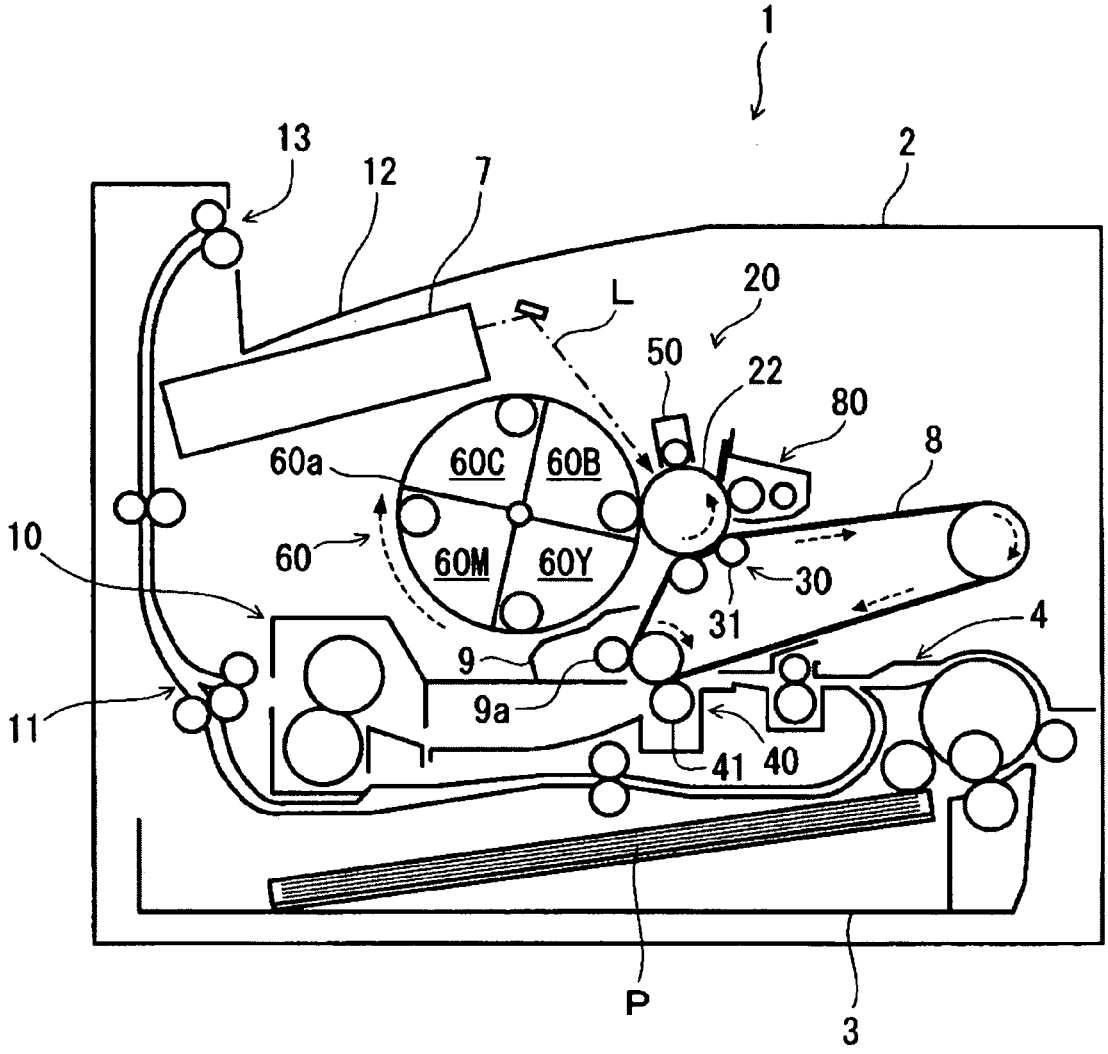
FIG. 5 is a schematic left side view in vertical section of an image forming apparatus according to a second embodiment of the invention.
Figure 6:
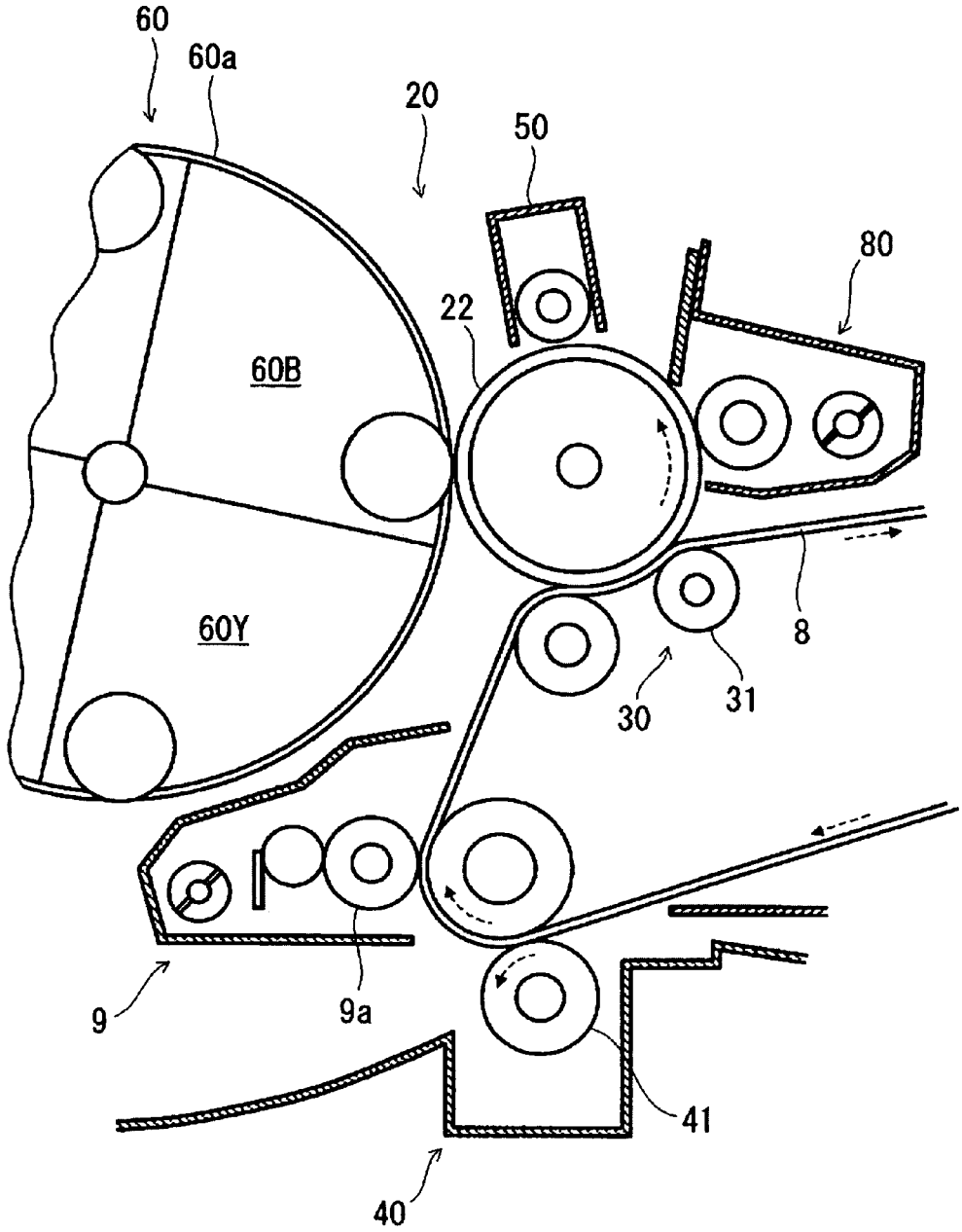
FIG. 6 is a partial enlarged vertical section showing the periphery of an image forming unit shown in FIG. 5.

Next, the construction and the image forming operation of an image forming apparatus according to a second embodiment of the present invention is described with reference to FIGS. 5 and 6. FIG. 5 is a schematic left side view in vertical section of the image forming apparatus, and FIG. 6 is a partial enlarged vertical section showing the periphery of an image forming unit shown in FIG. 5. This image forming apparatus is of the color printing type that has a configuration different from that of the first embodiment described with reference to FIGS. 1 to 3, but is the same in that toner images are transferred to a sheet using an intermediate transfer belt. No detailed description is given on elements having the same functions as those of the first embodiment by identifying them by the same reference numerals. It should be noted that the front and rear sides of the image forming apparatus are right and left sides in FIG. 5.

As shown in FIG. 5, a sheet cassette 3 is arranged at an inner bottom part of a main body 2 of an image forming apparatus 1 and a sheet conveying assembly 4 is arranged at a downstream side with respect to a direction of conveyance of a sheet from the sheet cassette 3. The sheet conveying assembly 4 extends to convey a sheet P dispensed to an upper right side from the sheet cassette 3 in FIG. 5 to left, i.e. toward the rear side of the main body 2, and leads to an image forming unit 20 and a secondary transfer device 40.

The image forming unit 20 is provided in its center with a single photoconductive drum 22 rotatable in counterclockwise direction in FIG. 5. A charging device 50, a developing device 60 and a drum cleaning device 80 are arranged around the photoconductive drum 22 in this order along a rotating direction of the photoconductive drum 22. In the image forming unit 20, an electrostatic latent image of a first color of a document image is first formed on the outer circumferential surface of the photoconductive drum 22 by the charging device 50 and an optical unit 7 arranged above the charging device 50. Electrostatic latent images corresponding to the respective colors are successively formed in image forming processes of the respective colors.

An essential part of the developing device 60 is comprised of a rotary rack 60*a* as a rotary body rotatable in clockwise direction in FIG. 5, and a total of four developing units are evenly arranged along circumferential direction in this rotary rack 60*a*. The four developing units are a black developing unit 60B, a cyan developing unit 60C, a magenta developing unit 60M and a yellow developing unit 60Y. The rotary rack 60*a* is rotated by unillustrated driving means and adapted to develop toner images of the respective colors on the outer circumferential surface of the photoconductive drum 22 by successively moving the four developing units to a position facing the photoconductive drum 22. As described above, the image forming unit 20 is a one-drum type image forming unit for developing toner images of a plurality of colors on the single photoconductive drum 22.

The intermediate transfer belt 8 embodying the intermediate transfer member in the form of an endless belt is arranged at a position just proximate to and below the photoconductive drum 22 and is turned in clockwise direction in FIG. 5. The intermediate transfer belt 8 is brought into pressing contact with the photoconductive drum 22 from below and constructs a primary transfer device 30 including a primary transfer roller 31 shown in FIG. 6. The toner images formed on the outer circumferential surface of the photoconductive drum 22 are transferred to the outer surface of the intermediate transfer belt 8 as the primary transfer in this primary transfer device 30. After the primary transfer, the toner residual on the outer circumferential surface of the photoconductive drum 22 is collected (cleaned) by the drum cleaning device 80.

Then, the intermediate transfer belt 8 makes one turn to come to a specified primary transfer position relative to the photoconductive drum 22 for the primary transfer of the next color. If the toner image to be formed is a black toner image, the primary transfer process ends here. If the toner image to be formed is a full-color toner image, the image forming process comprised of the development, the primary transfer and the cleaning as for the first color is successively repeated for each of the second to the fourth colors. In this way, a full-color toner image in which the toner images of the four colors of black, cyan, magenta and yellow are superimposed is formed on the outer surface of the intermediate transfer belt 8.

A secondary transfer device 40 including a secondary transfer roller 41 is arranged at a position where the intermediate transfer belt 8 passes the sheet conveying assembly 4 (place where the intermediate transfer belt 8 and the sheet conveyance path of the sheet conveying assembly 4 are proximate to each other). The secondary transfer roller 41 is vertically moved in FIG. 6 to be brought into pressing contact with the intermediate transfer belt 8 or to be separated from the intermediate transfer belt 8. A belt cleaning device 9 is provided downstream of the secondary transfer device 40 with respect to a direction of sheet conveyance. A cleaning brush 9*a* of this belt cleaning device 9 is also moved into pressing contact with and away from the intermediate transfer belt 8 according to needs. It should be noted that the secondary transfer roller 41 and the cleaning brush 9*a* are away from the intermediate transfer belt 8 while the toner images of the respective colors are successively transferred to the intermediate transfer belt 8 as the primary transfer.

When the color toner image of four colors or the black toner image is formed on the outer surface of the intermediate transfer belt 8, the secondary transfer roller 41 is brought into pressing contact with the intermediate transfer belt 8, whereby the toner image on the outer surface of the intermediate transfer belt 8 is transferred to a sheet P as the secondary transfer in this secondary transfer device 40. After the secondary transfer, the toner residual on the outer surface of the intermediate transfer belt 8 is collected (cleaned) by the belt cleaning device 9 held in pressing contact with the intermediate transfer belt 8.

Thereafter, the sheet P bearing the unfixed toner image is conveyed to a fixing device 10 shown in FIG. 5 to have the toner image fixed by a heating roller and a pressure roller. The sheet P discharged from the fixing device 10 is discharged to a sheet discharging portion 12 provided on the upper surface of the main body 2 via a junction portion 11 and a switchback portion 13.

As described above, the intermediate transfer belt 8 (intermediate transfer member) formed by an endless belt is provided, the image forming operation shown in FIG. 4 is performed even if the image forming unit 20 is of the one drum type in which the toner images of a plurality of colors are developed on the single photoconductive drum 22, and the toner residual on the outer surface of the intermediate transfer belt 8 is collected (cleaned). Thus, similar to the case of the tandem type of the first embodiment, the toner charged to have a polarity opposite to the normal charged polarity can be collected by the cleaning device 80 for the photoconductive drum 22 of the image forming unit 20 and the toner can be securely cleaned and collected regardless of whether the toner is positively or negatively charged. Accordingly, good cleaning performance can be maintained and the full-color image forming apparatus of the one-drum type can be provided which can securely prevent an occurrence of an image error.

It should be appreciated that the scope of the present invention is not limited to the above described embodiments of the present invention, and various changes can be made without departing from the scope and spirit of the present invention.

This application is based on patent application No. 2006-017579 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

an image forming unit including an image bearing member and adapted to form a toner image on the image bearing member using toners of a plurality of different colors, a rotatable intermediate transfer member, a primary transfer device for transferring the toner image from the image bearing member to the outer surface of the intermediate transfer member as primary transfer by applying a primary transfer bias, a secondary transfer device for transferring the toner image from the outer surface of the intermediate transfer member to a sheet as secondary transfer by applying a secondary transfer bias, an image bearing member cleaning device which comes in contact with and which removes residual toner remaining on the surface of said image bearing member;

an intermediate transfer member cleaning device having a cleaning brush that is movable into pressing contact with the intermediate transfer member for removing residual toner remaining on the outer surface of the intermediate transfer member after the secondary transfer by applying to the cleaning brush a cleaning bias having the same polarity as the primary transfer bias so that the residual toner on the outer surface of the intermediate transfer member moves toward the cleaning brush, and a controller for controlling the rotation of the intermediate transfer member and the application of the primary transfer bias, wherein a toner image forming area on the outer surface of the intermediate transfer member passes said primary transfer device, said secondary transfer device, and said intermediate transfer cleaning device, and then passes again the primary transfer device while said intermediate transfer member is being rotated under the control of said controller, and said controller controls the primary transfer device to continuously apply the primary transfer bias during a period from a start of the primary transfer until said toner image forming area has passed said primary transfer device a second time after having passed said intermediate transfer cleaning device so that the residual toner remaining on said image bearing member without being removed by said intermediate transfer cleaning device is removed by the image bearing member cleaning device, said controller further controlling the primary transfer device to stop the primary transfer bias after said toner image forming area has passed said primary transfer device the second time and stopping of the intermediate transfer member when the primary transfer bias is stopped.

2. An image forming apparatus according to claim 1, wherein the image forming apparatus is a tandem-type image forming apparatus in which the intermediate transfer member is an endless belt and a plurality of primary transfer devices and a plurality of image forming units are arranged in a row along a turning direction of the belt, and the controller causes any one of the plurality of primary transfer devices to apply the primary transfer bias.

3. An image forming apparatus according to claim 2, wherein the controller causes the plurality of primary transfer devices to alternately apply the primary transfer biases of minus and plus polarities or plus and minus polarities from an upstream side with respect to the turning direction of the intermediate transfer member.

4. An image forming apparatus according to claim 1, wherein the image forming apparatus is a one-drum type image forming apparatus in which the intermediate transfer member is an endless belt and the image forming unit successively develops the toner images of the plurality of colors on the single image bearing member.

* * * * *